US010030860B2

(12) United States Patent
Bergman et al.

(10) Patent No.: US 10,030,860 B2
(45) Date of Patent: Jul. 24, 2018

(54) HEAVY LIGHT, AMBIENT EXPERIENCE LUMINAIRE

(71) Applicant: PHILIPS LIGHTING HOLDING B.V., Eindhoven (NL)

(72) Inventors: Anthonie Hendrik Bergman, Neunen (NL); Anika Nelleke Siepel, Eindhoven (NL); Marjolein Dimmie Van Der Zwaag, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/506,920

(22) PCT Filed: Jul. 30, 2015

(86) PCT No.: PCT/EP2015/067509
§ 371 (c)(1),
(2) Date: Feb. 27, 2017

(87) PCT Pub. No.: WO2016/030123
PCT Pub. Date: Mar. 3, 2016

(65) Prior Publication Data

US 2017/0254524 A1 Sep. 7, 2017

(30) Foreign Application Priority Data

Aug. 27, 2014 (EP) ..... 14182484

(51) Int. Cl.
*F21V 23/04* (2006.01)
*F21S 6/00* (2006.01)
(Continued)

(52) U.S. Cl.
CPC ..... *F21V 23/0492* (2013.01); *A63B 23/185* (2013.01); *F21S 6/004* (2013.01); *H05B 33/0872* (2013.01)

(58) Field of Classification Search
CPC ..... F21V 23/04; F21V 23/0492; F21S 10/00; F21S 6/00; F21S 6/004; F21L 4/00;
(Continued)

(56) References Cited

U.S. PATENT DOCUMENTS 6,676,284 B1 * 1/2004 Wynne Willson ..... F21S 8/032 362/231
8,053,994 B2 * 11/2011 Liu ..... H05B 37/0227 307/119
(Continued)

FOREIGN PATENT DOCUMENTS

DE 19653081 A1 6/1998
EP 2407708 A2 1/2012
(Continued)

*Primary Examiner* — Thai Pham
(74) *Attorney, Agent, or Firm* — Akarsh P. Belagodu

(57) ABSTRACT

A lighting device is provided, a plurality of light sources are located within a housing of the lighting device. A sensor is also provided to determine an indication of the point of lowest potential energy and/or the point of highest kinetic energy. This sensor output is input to a controller that is configured to determine a change in the position or a movement of the point of lowest potential energy and/or the point of highest kinetic energy as the position of the lighting device changes based on the sensor output and to change a property of the light emitted by the plurality of light sources based on the change of position or a movement of the point of lowest potential energy and/or the point of highest kinetic energy.

20 Claims, 6 Drawing Sheets

(51) Int. Cl.
*A63B 23/18* (2006.01)
*H05B 33/08* (2006.01)

(58) Field of Classification Search
CPC ..... A63B 23/18; A63B 23/185; H05B 33/08; H05B 33/0872
See application file for complete search history.

(56) References Cited

U.S. PATENT DOCUMENTS

| | | | | |
|---|---|---|---|---|
| 2013/0225037 | A1 | 8/2013 | Deluz | |
| 2014/0210375 | A1 | 7/2014 | Naumann | |
| 2016/0330825 | A1* | 11/2016 | Recker ..... | H05B 37/0272 |

FOREIGN PATENT DOCUMENTS

| | | | |
|---|---|---|---|
| WO | 0014705 | A1 | 3/2000 |
| WO | 03008858 | A1 | 1/2003 |
| WO | 2013029366 | A1 | 3/2013 |

* cited by examiner

HEAVY LIGHT, AMBIENT EXPERIENCE LUMINAIRE

CROSS-REFERENCE TO PRIOR APPLICATIONS

This application is the U.S. National Phase application under 35 U.S.C. § 371 of International Application No. PCT/EP2015/067509, filed on Jul. 30, 2015, which claims the benefit of European Patent Application No. 14182484.7, filed on Aug. 27, 2014. These applications are hereby incorporated by reference herein.

FIELD OF THE INVENTION

The invention relates to the field of luminaires, and more specifically to an interactive luminaire.

BACKGROUND OF THE INVENTION

Linear light effect luminaires provide a visually attractive light effect. EP1110198 entitled "Apparatus and method for providing a linear effect" describes a luminaire having a plurality of light sources of one color and a plurality of light sources having a second color being arranged in a line and in close proximity to one another. These are controllable so that the light output is perceived as emanating from a substantially continuous light source rather than a plurality of individual sources.

SUMMARY OF THE INVENTION

It would be advantageous to achieve an interactive luminaire having a linear light effect that mimics a fluid flow, that is to say that a volume of light acts as if it were a volume of fluid. To better address one or more of these concerns, in a first aspect of the invention, there is provided a lighting device comprising

- a housing,
- a plurality of light sources
- at least one sensor for determining an indication of the point of lowest potential energy and/or the point of highest kinetic energy for every position of the lighting device, and
- a controller, wherein the lighting device is moveable and wherein said controller is configured to determine, based on the indication of the point of lowest potential energy and/or the point of highest kinetic energy output by said at least one sensor, a change in the position or a movement of the point of lowest potential energy and/or the point of highest kinetic energy as the position of said lighting device changes and to change a property of the light emitted by the plurality of light sources based on the change in the position or a movement of the point of lowest potential energy and/or the point of highest kinetic energy.

These and other aspects of the invention will be apparent from and elucidated with reference to the embodiments described hereinafter.

BRIEF DESCRIPTION OF THE DRAWINGS

Examples of the invention will now be described in detail with reference to the accompanying drawings, in which.

DETAILED DESCRIPTION OF EMBODIMENTS

Figure 1:
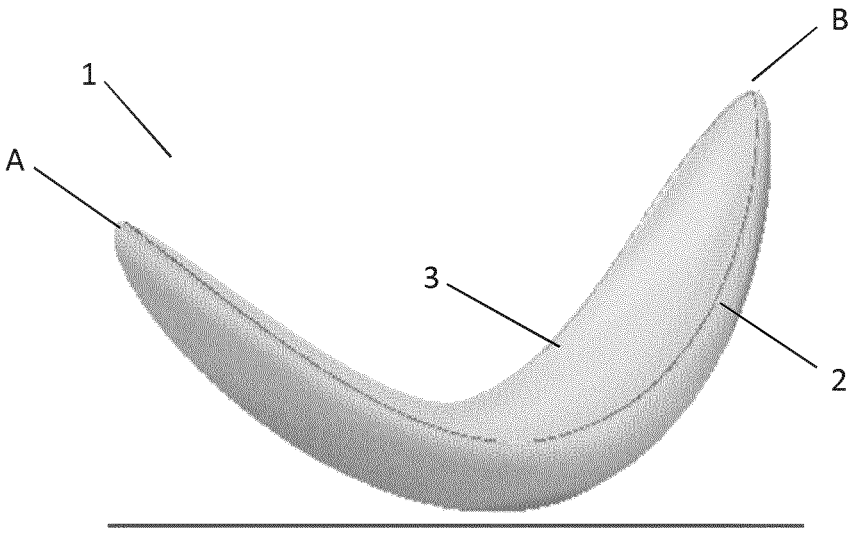
FIG. 1 shows an embodiment of a lighting device.

FIG. 1 shows an embodiment of a lighting device 1 which is moveable by a user. The lighting device has a housing 2 which in this embodiment is a curved, rigid housing. This housing has a first end A and a second end B. The lighting device may emit light from a single face 3 or it may emit light from substantially the entire housing 2.

Figure 2:
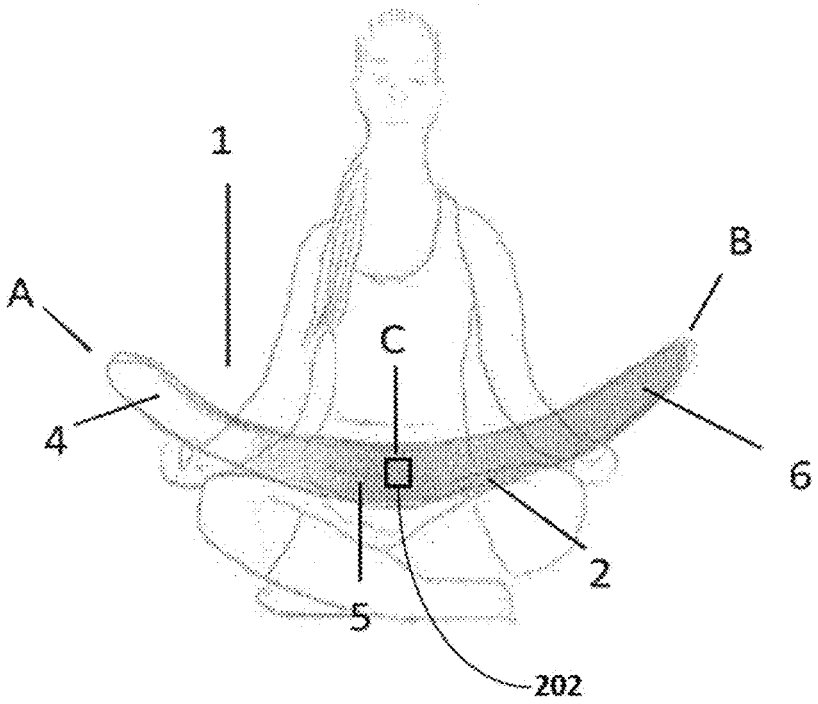
FIG. 2 shows an embodiment of a lighting device in a first position.

FIG. 2 shows an embodiment of a lighting device 1 in a first position. The lighting device 1 emits light from substantially the entire housing 2. In this embodiment the light sources are separated into three regions, a first region 4 emits light with a first color, a second region 5 emits light with a second color and a third region 6 emits light with a third color. Alternatively the first region 4 emits light with a first intensity, the second region 5 emits light with a second intensity and the third region 6 emits light with a third intensity.

The controller (not shown) is configured to determine, based on the indication of the point of lowest potential energy and/or the point of highest kinetic energy output by said at least one sensor, a change in the position or a movement of the point of lowest potential energy and/or the point of highest kinetic energy as the position of said lighting device changes and to change a property of the light emitted by the plurality of light sources based on the change in the position or a movement of the point of lowest potential energy and/or the point of highest kinetic energy.

The determination of the lowest point of potential energy can be understood as a determination of the lowest point's position relative to the surface of the earth. This is because the gravitational potential energy of an object depends on its vertical position relative to the earth and it's mass. It can be understood that the mass of the lighting device is a constant value and so the variable parameter is the vertical position of the lighting device relative to the earth.

Gravitational energy is the potential energy associated with gravitational force as work is required to elevate objects against Earth's gravity. The potential energy due to elevated positions is called gravitational potential energy and is evidenced by water in an elevated reservoir or kept behind a dam.

In this embodiment, the controller may be configured to provide a linear light effect using the light source regions 4, 5, & 6 in a sequential manner.

An alternative method of sensing the lowest point of potential energy may utilise an inclinometer 202 that is located at a midpoint C of the housing 2. The inclinometer 202 will be able to calculate the relative position of a first end A and a second end B of the housing 2 in relation to the midpoint C. It can be seen that the first end A and the second end B of the housing 2 are a similar relative position to the midpoint C of the housing 2.

The controller may control light source region 5 to output light with the greatest intensity when the sensor determines that the first end A of the housing 2 and the second end B are the same relative height from the midpoint C of the housing 2. Alternatively the controller may control the light source region 5 to output light of a first color whilst region 4 outputs light of a second color and region 6 outputs light of a third color. Obviously it is also possible for the light outputs of regions 4 and 6 to output light of the same color or intensity as each other as long as it is different to the light emitted by region 5.

Figure 3:
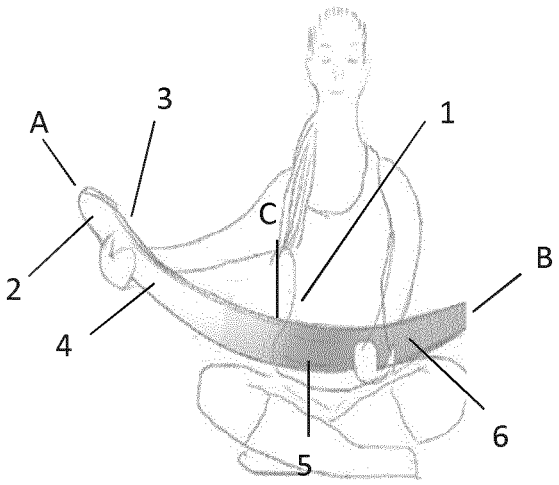
FIG. 3 shows an embodiment of a lighting device in a second position.

FIG. 3 shows an embodiment of a lighting device in a second position. It can be seen that the first end A of the housing 2 is higher relative to the midpoint C of the housing 2 than the second end B. In this embodiment the light sources are separated into three regions, a first region 4, a second region 5 and a third region 6. The first region 4 emits light of a first color, the second region 5 emits light of a second color and the third region 6 emits light of a third color. The controller may be configured to control the light output of the regions 4, 5 & 6 in dependence on the output of a sensor, for example an inclinometer. The light output of region 5 is of a different color than the light output of regions 4 and 6. The controller has determined that region 5 is the lowest light source region relative to the midpoint C of the housing 2, which in this embodiment is curved between first end A and second end B. The intensity of the light regions 4, 5 & 6 may be altered as well as, or instead of the alteration of the color of the light emitted.

It can be understood that the light sources may be RGB LEDs, that is to say the LEDs may emit light of any color than can be made from combinations of Red, Green or Blue, i.e. any color. Also it is to be understood that the color emitted by the light source regions 4, 5 & 6 may be continually changed by the controller based upon their relative position to the midpoint C of the housing 2.

The controller may emulate the flow of fluid using light of different colors or intensities. The regions may be of a higher or lower number than the 3 regions 4, 5 & 6 already disclosed. Preferably the number of light source regions corresponds to the number of light sources within the lighting device 1. The emulated fluid may be of a high viscosity such as an oil or it may be a low viscosity fluid such as water. This means that the linear light effect generated by the lighting device 1 as it emulates a fluid flow may be a fast acting change or it may be a more slow acting change. It can be seen that the volume of light is acting as if it were a volume of fluid to emulate the flow of the fluid.

It can be seen that the controller is configured to control the light output of the light sources based on sensor output however it could also control the light sources based on a predetermined algorithm. The lighting device 1 may emit light in a pattern that is suitable to guide a person in exercise, for example yoga or to provide a light pattern that could guide a user to a steady breathing rhythm when the breathing is timed to coincide with the displayed light pattern. This may prove advantageous in improving a person's wellness, relaxation or tranquillity.

The lighting device 1 may also emit light that improves a user's sense of balance and motor coordination skills; this may be achieved for example, by the lighting device emitting a colored light shape, such as a square, on the face 3. This square may move dependent on the sensed input of the position of the first end A and the second end B relative to the midpoint C of the housing 2. The goal of the user is to balance the colored square in a certain position on the face 3 by moving the lighting device 1 so that the relative positions of the first end A and the second end B to the midpoint C of the housing 2 are altered.

The sensor may be an accelerometer which would allow the determination of an indication of a centrifugal force. A centrifugal force is the apparent force that draws a rotating body away from the centre of rotation. It is caused by the inertia of the body as the body's path is continuously redirected.

The accelerometer is a device that measures the physical acceleration experienced by an object and can be used to sense orientation or a kinetic energy. The kinetic energy of an object is the energy that it possesses due to its motion. It is defined as the work needed to accelerate a body of given mass from rest to its stated velocity. Having gained this energy during its acceleration the body maintains this kinetic energy unless its speed changes.

This determination of an indication of a centrifugal force will allow a further light effect to be generated by the lighting device. If a user holds the lighting device and then rotates around their longitudinal axis (the axis that runs straight through the top of the head down between the feet) a point of highest kinetic energy will be located at the point of the lighting device that is furthest away from the axis. The light property may be changed to increase the intensity or to change color in a flowing manner toward the point of highest kinetic energy. This effect can also be achieved if the person does not rotate but merely swings the lighting device in an arc.

A combination of kinetic and potential energy is known as mechanical energy. It is the energy associated with the motion and position of an object. If an object is moved in the opposite direction of a conservative net force (for example gravity), the potential energy will increase and if the speed of the object is changed the kinetic energy of the object is changed as well. Thus in a mechanical system such as a swinging pendulum energy passes back and forth between kinetic and potential energy but never leaves the system. The pendulum reaches greatest potential energy and least potential energy when aligned vertically as it will have the greatest speed and be nearest the Earth at this point. On the other hand, it will have its greatest potential energy and its least kinetic energy at the two points at the furthest extents of its swing, because it has zero speed and is furthest from the Earth at these points.

Figure 4:
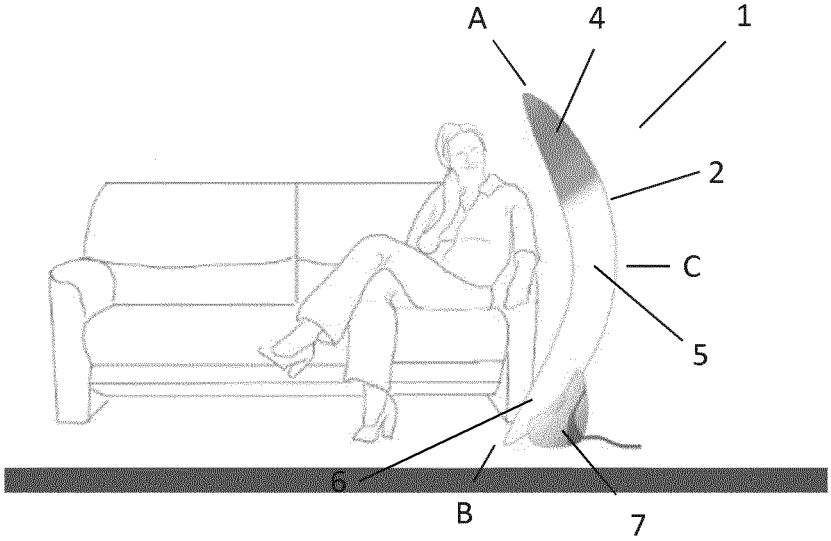
FIG. 4 shows an embodiment of a lighting device in a stand.

FIG. 4 shows an embodiment of a lighting device 1 that is supported by a base 7. This allows the lighting device to be a decorative device or alternatively to offer a range of functional and ambient lighting. The light source regions 4, 5 & 6 may output light of a first color, a second color, a third color or a first intensity, a second intensity and a third intensity or a combination of intensity and colors. There may be more than three light source regions 4, 5 & 6, preferably the number of light source regions match the number of light sources.

Figure 5:
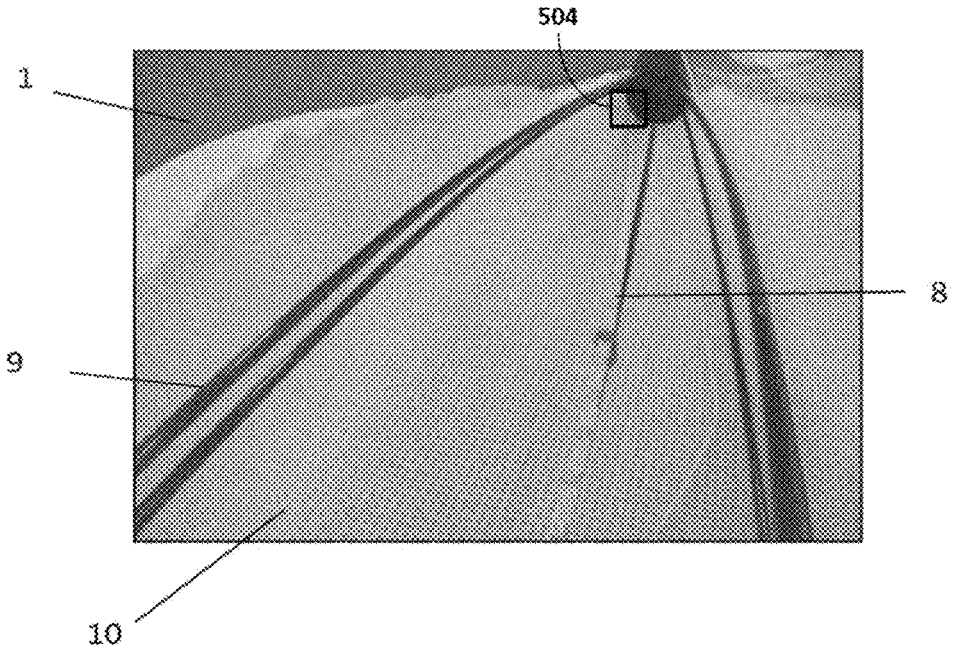
FIG. 5 shows an embodiment of an internal structure of a lighting device.

FIG. 5 shows an embodiment of an internal structure of a lighting device 1. The plurality of light sources 8 (in this example taking the form of an LED lighting strip) is located inside the housing along with the aforementioned controller, which is indicated at 504. The housing in this embodiment is constructed from a combination of a support structure 9 and a covering material 10.

Figure 6:
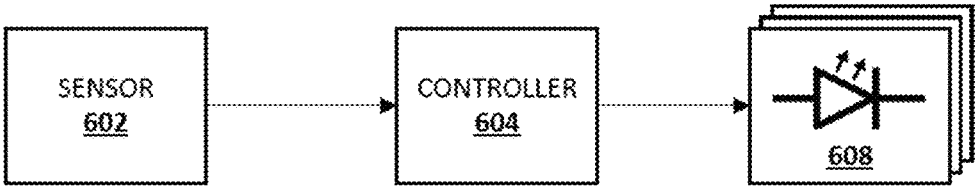
FIG. 6 schematically depicts components of various embodiments of the present disclosure.

FIG. 6 schematically depicts how a controller 604 may be operably coupled with a sensor 602 and a plurality of light sources 608. Sensor 602 may, for instance, correspond to inclinometer 202 of FIG. 2 or the accelerometer described elsewhere herein. Plurality of light sources 608 may correspond, for instance, to plurality of light sources 8 depicted in FIG. 5.

The invention claimed is:

1. A lighting device comprising:

a housing;

a plurality of light sources;

at least one sensor for determining an indication of the point of lowest potential energy for every position of the lighting device; and a controller;

wherein the lighting device is moveable and wherein said controller is configured to determine, based on the indication of the point of lowest potential energy output by said at least one sensor, a change in the position or a movement of the point of lowest potential energy as the position of said lighting device changes and to provide a linear light effect by changing a property of the light emitted by the plurality of light sources in a flowing manner emulating a fluid flow, toward the point of lowest potential energy.

2. The lighting device of claim 1 wherein a rate of change of the property of the light emitted by the plurality of light sources is dependent on a rate of change of position or movement of the point of lowest potential energy.

3. The lighting device of claim 1 wherein said at least one sensor comprises at least one of an accelerometer, a gyroscope, a pressure sensor, an altimeter, an inclinometer or a gravity sensor.

4. The lighting device of claim 1 wherein a substantial surface area of said housing is curved.

5. The lighting device of claim 4 wherein said controller is configured to change at least one of a hue, a saturation and an intensity of the light emitted in the vicinity of a lowest point of said lighting device.

6. The lighting device of claim 5 wherein said controller is configured to increase either a saturation or an intensity of the light emitted in the vicinity of the lowest point of said lighting device.

7. The lighting device of claim 1 wherein the lighting device comprises an elongated lighting device.

8. The lighting device of claim 1 wherein the lighting device comprises an elongated housing, said elongated housing further comprising, a first end A, a second end B, and a curved surface area between said first end A and said second end B.

9. The lighting device of claim 1 wherein the lighting device comprises a circular lighting device.

10. The lighting device of claim 9 wherein said lighting device comprises a planar circular lighting device.

11. The lighting device of claim 1 wherein the lighting device comprises a semi-spherical lighting device.

12. The lighting device of claim 1 wherein the lighting device comprises a spherical lighting device.

13. A method of controlling a light output of a plurality of light sources of a lighting device according to the steps of:

determining a point of lowest potential energy of the plurality of light sources based on an indication of the point of lowest potential energy for every position of the lighting device output by at least one sensor;

determining a change in the position or a movement of the point of lowest potential energy as the position of said lighting device changes; and providing a linear light effect by changing a property of the light emitted by the plurality of light sources in a flowing manner emulating a fluid flow, toward the point of lowest potential energy.

14. A lighting device comprising:

a housing;

a plurality of light sources;

at least one sensor for determining an indication of the point of highest kinetic energy for every position of the lighting device; and a controller operably coupled with the plurality of light sources and the at least one sensor;

wherein the lighting device is moveable and wherein said controller is configured to determine, based on the indication of the point of highest kinetic energy output by said at least one sensor, a change in the position or a movement of the point of highest kinetic energy as the position of said lighting device changes and to provide a linear light effect by changing a property of the light emitted by the plurality of light sources in a flowing manner emulating a fluid flow, toward the point of highest kinetic energy.

15. The lighting device of claim 14 wherein a rate of change of the property of the light emitted by the plurality of light sources is dependent on a rate of change of position or movement of the point of highest kinetic energy.

16. The lighting device of claim 14 wherein said at least one sensor comprises at least one of an accelerometer, a gyroscope, a pressure sensor, an altimeter, an inclinometer or a gravity sensor.

17. The lighting device of claim 14 wherein a substantial surface area of said housing is curved.

18. The lighting device of claim 17 wherein said controller is configured to change at least one of a hue, a saturation and an intensity of the light emitted in the vicinity of a lowest point of said lighting device.

19. The lighting device of claim 18 wherein said controller is configured to increase either a saturation or an intensity of the light emitted in the vicinity of the lowest point of said lighting device.

20. The lighting device of claim 14 wherein the lighting device comprises an elongated lighting device.

* * * * *